United States Patent [19]

Stonebraker

[11] 4,017,969

[45] Apr. 19, 1977

[54] CUTTING INSTRUMENT

[76] Inventor: Robert E. Stonebraker, Box 222, R.D. No. 3, Tyrone, Pa. 16686

[22] Filed: Apr. 20, 1976

[21] Appl. No.: 678,478

[52] U.S. Cl. ..... 30/156; 30/40; 30/335

[51] Int. Cl.[2] ..... B26B 3/06; F41B 13/02; F41C 27/02

[58] Field of Search ..... 30/156, 335, 40

[56] References Cited

UNITED STATES PATENTS

| | | | |
|---|---|---|---|
| 1,706,251 | 3/1929 | Perry | 30/156 X |
| 2,037,914 | 4/1936 | McCullough et al. | 30/335 X |
| 2,081,232 | 5/1937 | Haas | 30/156 |
| 2,134,973 | 11/1938 | Harwell | 30/156 |

*Primary Examiner*—Al Lawrence Smith
*Assistant Examiner*—J. T. Zatarga
*Attorney, Agent, or Firm*—Thomas E. Sterling

[57] ABSTRACT

This invention comprises a foldable knife, having replacement blades contained pivotably within a case in one position and extending outwardly therefrom in a second position. Thus the invention is comprised of a case, a rotable blade holder pivotably attached to said case, the blade holder adapted to receive a sharpened blade, a slideable ejector rod positioned in said case, and upon a blade track, adapted to eject the blade from said blade holder when the blade holder is in the outward extended position. This ejection is done by pressing an ejector button attached to said ejector forward with the fingers. A blade lock member is spring biased against the cammed end portion of said blade holder whereby the blade holder is held securely by a cam in its outward extended position.

8 Claims, 8 Drawing Figures

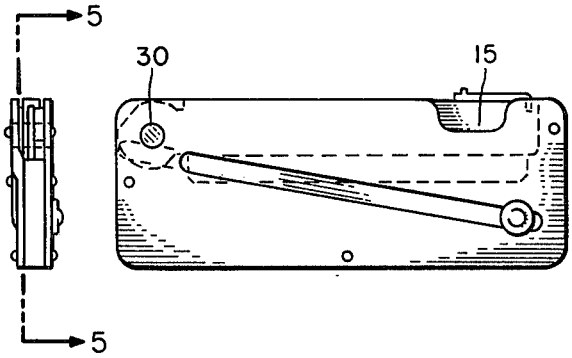
Fig. 2.
Fig. 1.
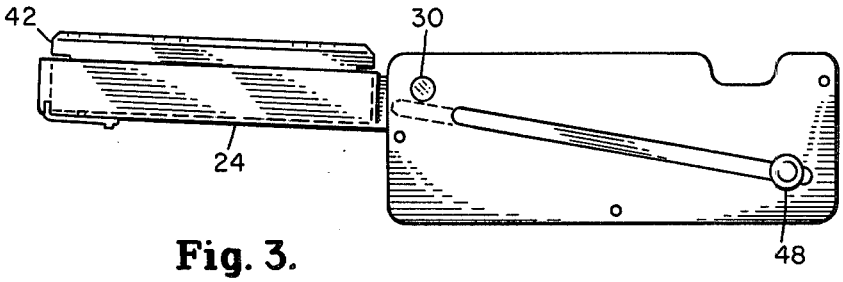
Fig. 3.
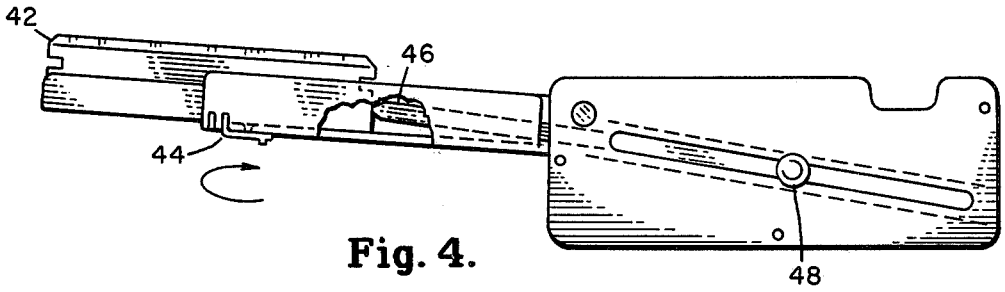
Fig. 4.
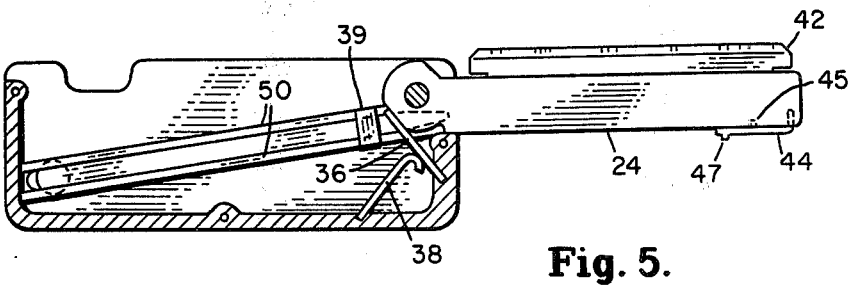
Fig. 5.
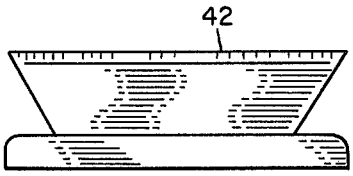
Fig. 6.
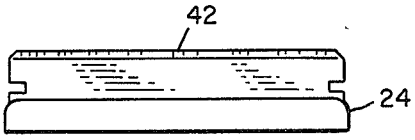
Fig. 7.

CUTTING INSTRUMENT

This invention relates to cutting instruments and more particularly to foldable cutting knives having a replaceable blade thereon.

An object of this invention is to provide a new and novel cutting instrument.

Another object of this invention is to provide a new and novel interchangeable blade knife having a means for ejecting the blade contained therein.

Another object of this invention is to provide a new and novel cutting knife with an interchangeable blade that may be changed easily without the use of external tools.

Yet another object of this invention is to provide a new and novel foldable knife with interchangeable blades.

FIG. 1 is a side view of the invention, partially in section, showing the blade folded within the case.

FIG. 2 is an end view of the invention shown in FIG. 1.

FIG. 3 is a side view of the invention showing the blade holder and blade in their extended position.

FIG. 4 is a side view of the invention with the blade holder in its extended position and also showing the ejector rod positioned to eject the blade in the blade holder.

FIG. 5 is a sectional side view of the invention with the blade holder in an extended position having the side piece of the case removed.

FIG. 6 is a side view of a heavy blade type used in said invention.

FIG. 7 is a side view of a razor-type blade used in said invention.

Figure 8:
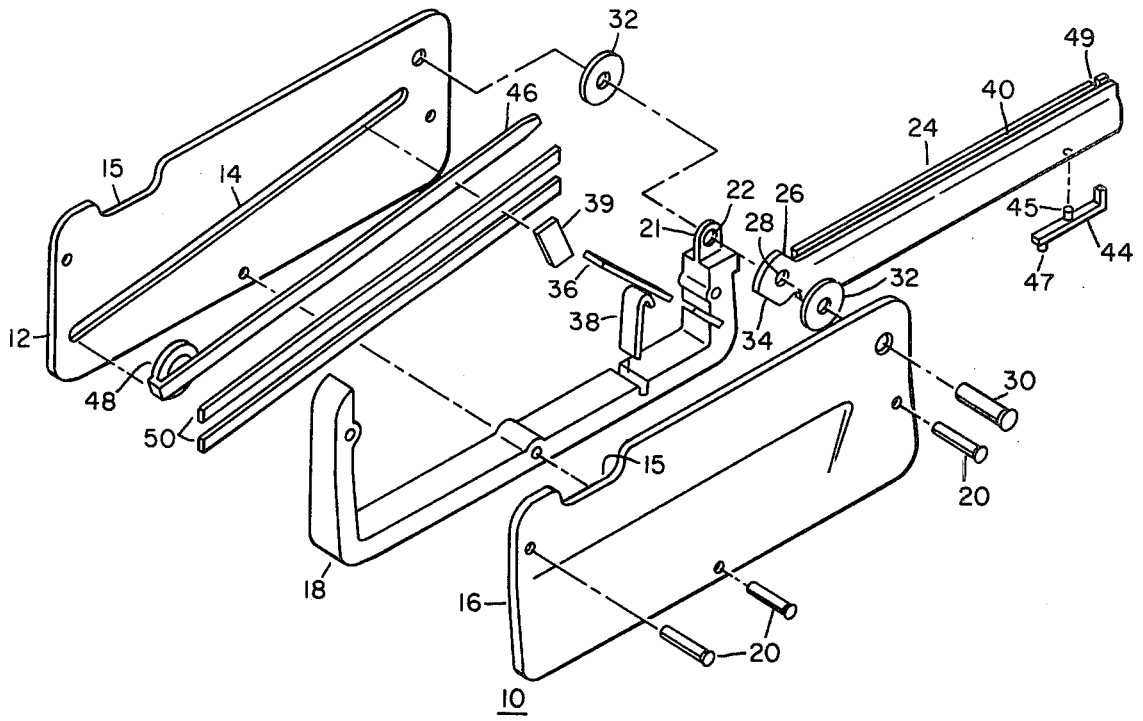
FIG. 8 is a three dimensional exploded view showing the parts of the invention.

Referring now to the drawings, (and in particular FIGS. 1–5 inclusive), 10 represents the rectangularly shaped case within which the invention is housed. Case 10 is comprised of side piece 12 having a diagonal groove 14 therethrough; oppositely positioned side piece 16 and U-shaped spacer member 18 positioned between side pieces 12 and 16. The upper portion of side pieces 12 and 16 has a finger indentation 15 therein to permit the grasping of the blade holder 24, later described. Rivets 20 extend through side pieces 12 and 16 and spacer member 18 holding the case 10 together. The forward and upward portion of spacer member 18 has an upwardly extending flange 21 thereon with a flange hole 22 therethrough.

The blade holder 24 has an end portion blade pivot 26 and a pivot hole 28 in said blade pivot 26. Blade holder 24 is pivotably attached to case 10 by a pivot rivet 30 extending through side pieces 12, 16, and pivot hole 28. Washers 32 are positioned on pivot rivet 30 insuring a tight fit for blade holder 24. Thus blade holder 24, will rotate from within case 10 upon pivot rivet 30 to an upwardly extended position. Blade holder 24 is a member having a U-shaped cross section with parallel sides and a blade holder slot 40 therebetween. A blade 42 may be slid into blade holder slot 40 and held in rigid position. A blade lock member 44, positioned at the bottom end portion of blade holder 24 them locks the blade 42 within blade holder 24 so that it may not be withdrawn.

Blade pivot 26 is generally circular in shape having a flat cam surface 34 thereon. A blade lock member 36 is fitted within a slot 40 in spacer member 18 and in contact with blade pivot 26. A bias spring 38 is positioned within a slot in spacer member 18 and is biased against blade lock member 36 pressing it against blade pivot 26. When the blade holder 24 is in its extended position, blade lock 36 will be pressed against the cam surface 34 of blade pivot 26, thus locking blade holder 24 in its outward and extended position. Bias spring cover 39 is positioned within case 10 and encloses bias spring 38.

Blade lock member 42 is generally L-shaped having a mid-positioned rivet 45 therethrough which attaches to the bottom portion of blade holder 24 allowing lock member 42 to rotate. A lock button 47 on the outward end portion of lock member 42 is provided to rotate the lock member 42. A lock slot 49 in the side portion of blade holder 24 receives the end portion of lock member 44 and when in locking position, blocks blade holder slot 40, thus locking blade 42 within blade holder 24. Rotation of lock member 42 allows the locking or unlocking of the blade 42 within blade holder 24.

Referring to FIGS. 4 and 5, an ejector rod 46 is positioned within case 10 directly adjacent to the diagonal groove 14 and having an ejector rod button 48 integrally connected to the end portion of ejector rod 46 and extending through side piece 12 to the outside thereof. Ejector rod 46 is slidably positioned between parallel tracks 50 attached to the side of side piece 12, allowing ejector rod 46 to slide outwardly thereon. When blade holder 24 is in its outwardly extended position, ejector rod 46 may be slid outwardly and into blade holder slot 40 and to push out blade 42 therein. In order to do this of course, blade lock 44 must be rotated to disengage and allow the blade 42 to slide out of blade holder 24.

In operation, the invention is carried with the blade holder 24 pivoted so that the blade holder 24 and attached blade 42 are contained within the case 10. When it is desired to utilize the knife, the blade holder 24 and attached blade 42 are grasped with the fingers through finger indentation 15 of side pieces 12 and 16. The blade holder 24 and blade 42 are then withdrawn to the outwardly exended position and the knife utilized in the usual fashion. When it is desired to replace blade 42 the blade holder 24 is placed in the outwardly extended position, blade lock member 42 disengaged and ejector rod button 48 pushed down diagonal groove 14 forcing the ejector rod 46 into the blade holder slot 40 thus pressing blade 42 outwardly and out of the blade holder 24.

When it is desired to insert a new blade, the ejector rod 46 is finger pressed down track 50 to within the case 10. A new blade 42 is then pressed into blade holder slot 40 until it is fully within blade holder 24, then blade lock member 44 is engaged, locking in blade 42. The knife may thereafter be used in the conventional manner. At the end of use, blade holder 24 may be pivoted about pivot rivet 30 until it is within case 10.

It should be noted that bias spring 38 bears against blade lock member 36 which presses blade pivot 26 offering resistance to the rotation of blade holder 24. When blade holder 24 is in its outward and extended position, blade lock 36 will bear against cam surface 34 blade pivot 26 thus securing blade holder 24 in its outward and extended position.

I claim:

1. A cutting instrument comprising in combination:

A case having a track groove on one side thereof;

A blade pivot rotably attached to said case;

A blade holder having a blade track integrally attached to said blade pivot and adapted to receive a blade, said blade pivot being generally circular in shape with a flat cam surface thereon;

A blade slidably positionable upon said blade holder;

An ejector rod positioned within said case and aligned with said blade track when the instrument is in its open position;

An ejector button integrally attached to said ejector rod and extending through said track groove to the outside portion of said case;

A blade lock member positioned within said case and against said blade pivot;

A blade lock spring attached to said case and biasing said blade lock member against said blade pivot;

A stop member integrally positioned on said case at the end of said track groove and adapted to stop said ejector button when it is slid up said track groove.

2. The combination as claimed in claim 1 in which said blade lock member is attached to the interior portion of said case.

3. The combination as claimed in claim 2 in which a pivoting member extends through said case and through said blade pivot, whereby said blade pivot may pivot about said pivoting member.

4. The combination as claimed in claim 3 in which said track groove and blade track extend diagonally with respect to a side of said case when the instrument is in its open position.

5. The combination as claimed in claim 4 in which said blade holder is comprised of in combination:

A blade-retaining member positioned on the end portion of said blade holder and adapted to retain said blade within said blade holder.

6. The combination as claimed in claim 5 in which said case is generally rectangular in shape, having an interior and exterior portion thereof.

7. The combination as claimed in claim 6 in which said blade is comprised of in combination:

A cutting member;

A flange member integrally attached to the edge portion of said cutting member;

Said flange member adapted to engage said blade holder.

8. The combination as claimed in claim 7 in which said blade holder is comprised of two tracks in a general parallel position to one another and adapted to receive flange member of said blade.

* * * * *